United States Patent [19]

Cain

[11] 4,389,284

[45] Jun. 21, 1983

[54] CHARGING HOLE COVER SEAL

[75] Inventor: George R. Cain, Pittsburgh, Pa.

[73] Assignee: Koppers Company, Inc., Pittsburgh, Pa.

[21] Appl. No.: 334,966

[22] Filed: Dec. 28, 1981

[51] Int. Cl.[3] ..... C10B 25/20; C10B 25/24

[52] U.S. Cl. ..... 202/247; 202/251; 202/269

[58] Field of Search ..... 202/242, 245, 247, 248, 202/250, 251, 269; 49/463, 483, 485

[56] References Cited

U.S. PATENT DOCUMENTS

| | | | |
|---|---|---|---|
| 1,124,607 | 1/1915 | Gardner | 202/250 |
| 2,203,698 | 6/1940 | Schmidt | 202/250 |
| 3,689,369 | 9/1972 | Tucker | 202/251 |
| 3,900,369 | 8/1975 | Irie et al. | 202/247 |
| 4,145,259 | 3/1979 | Leumann | 202/248 |
| 4,186,056 | 1/1980 | Muller et al. | 202/250 |

FOREIGN PATENT DOCUMENTS

| | | | |
|---|---|---|---|
| 2831511 | 1/1980 | Fed. Rep. of Germany | 202/251 |

*Primary Examiner*—Bradley Garris

*Attorney, Agent, or Firm*—Daniel J. Long; Herbert J. Zeh, Jr.

[57] ABSTRACT

A charging hole cover sealing structure in which a disc-shape cover is superimposed over the charging hole and an annulus-shaped charging hole frame. The frame has on its top surface a peripheral medial groove and an inner planar surface. The cover has a lip with a terminal downwardly projecting peripheral tongue that engages the medial groove on the frame as the lip abuts its inner planar surface so that dual gas tight seals are established. A primary continuous seal is established at the point where the lip abuts the inner planar surface on the frame. The groove is filled with a heat resistant particulate material which will cause any coke oven gases escaping through this primary seal to be condensed so as to form a particularly effective sealant material made up of a mixture of the resultant tarry condensation with the particulate material. A secondary seal is thereby established between the tongue of the cover and the lid, and the need to manually apply a sealant composition to the charging hole cover is avoided.

7 Claims, 8 Drawing Figures

CHARGING HOLE COVER SEAL

BACKGROUND OF THE INVENTION

1. Field of the Invention

The present invention deals with coke ovens and, in particular, with coke oven charging hole covers.

2. Description of the Prior Art

Coke ovens are conventionally filled with coal in preparation for the coking process through a plurality of charging holes located on the battery top. The removable covers for these charging holes have generally consisted of a single cast iron plate which rests on the charging hole frame so as to form a gravity seal peripherally around the charging hole where the cover contacts the frame. It is found, however, that because these charging hole covers are frequently subjected to extreme temperatures that they may tend to warp so that the above mentioned seals do not always remain gas tight. Thus, after each time that a cover is placed over the charging hole, it may be necessary to manually overlay the edges of that cover with a sealant composition known as a mud so as to prevent the escape of pollutants. Since this mudding procedure is both laborious and time consuming, it is the object of the present invention to provide a coke oven charging hole cover which is effectively sealed so as to avoid the necessity for such a manual application of a sealant composition.

SUMMARY OF THE INVENTION

The present invention is a coke oven charging hole cover having an improved sealing structure. This charging hole cover rests on an annulus-like frame surrounding the charging hole, and this frame has on its top end a peripheral medial groove containing a particulate material and a inner planar surface. The cover is disc-shaped and has a lip projecting outwardly from its upper end. At the terminal end of this lip there is a downwardly projecting tongue which rests on the particulate material in the frame groove to form one seal. Another seal is formed at the point where the lip of the cover abuts the inner planar surface fo the frame top.

BRIEF DESCRIPTION OF THE DRAWINGS

The present invention is further described in the accompanying drawing in which.

DETAILED DESCRIPTION

Figure 1:
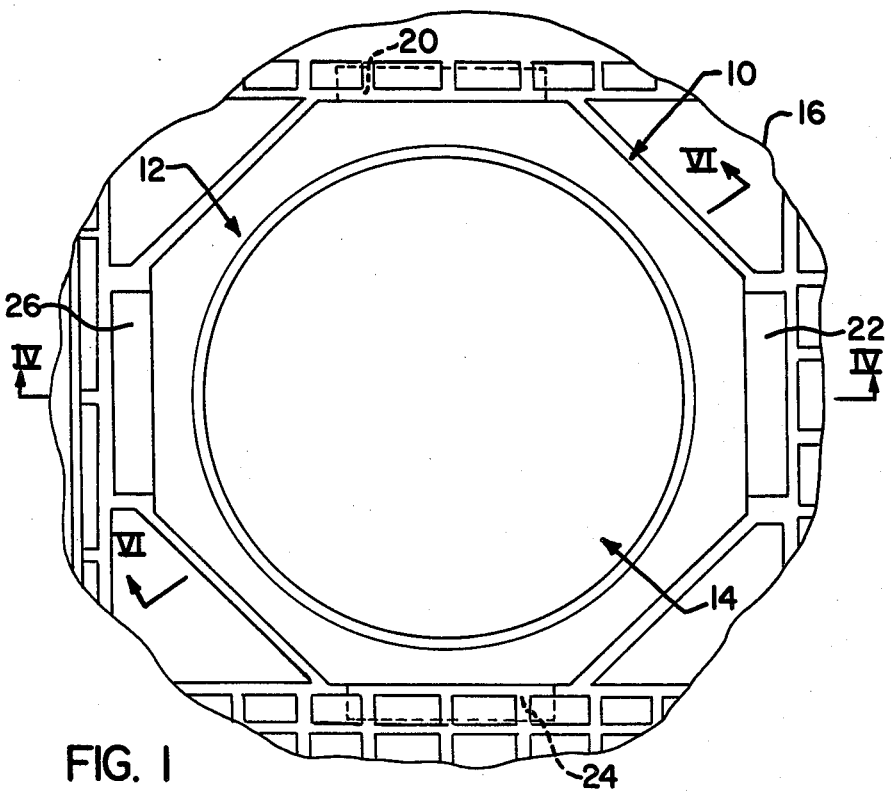
FIG. 1 is a plan view of a charging hole cover and frame of the present invention.
Figure 2:
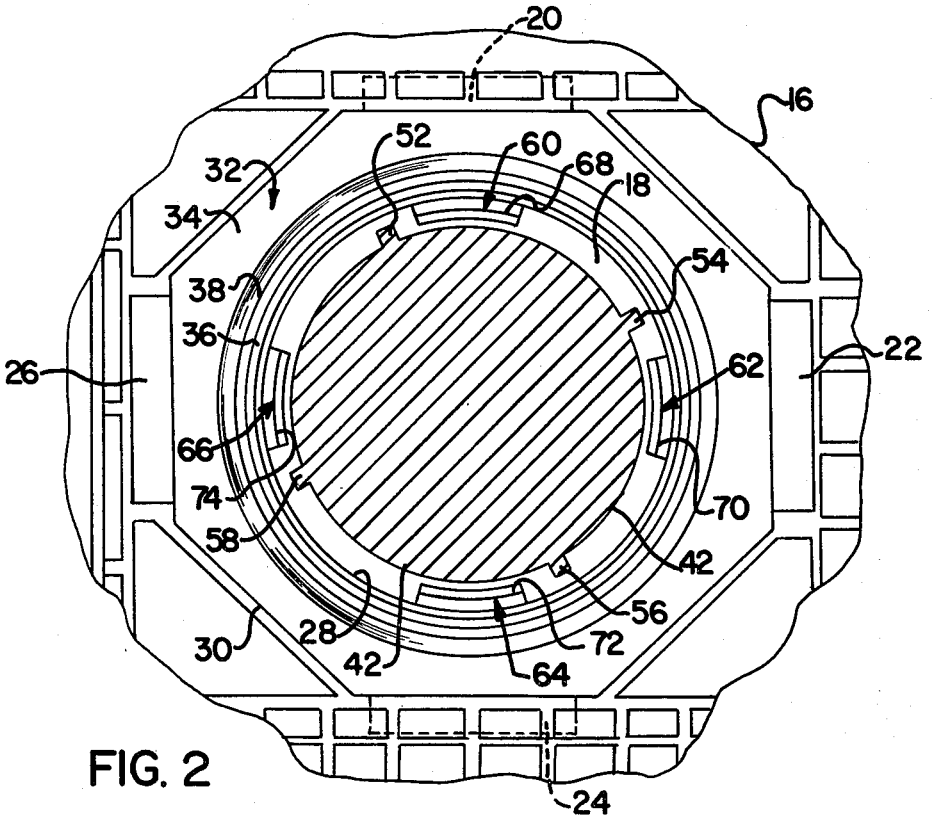
FIG. 2 is a cut away plan view of the charging hole cover and frame shown in FIG. 1.
Figure 3:
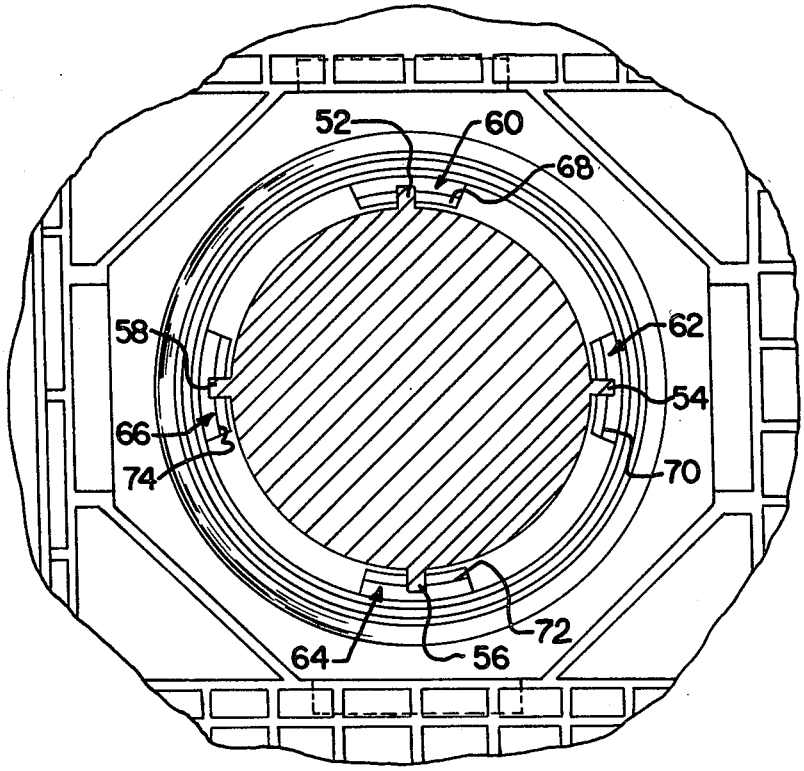
FIG. 3 is another cut away plan view of the charging hole cover and frame shown in FIG. 1 where the charging hole cover has been rotated on its vertical axis from its position shown in FIG. 2.
Figure 4:
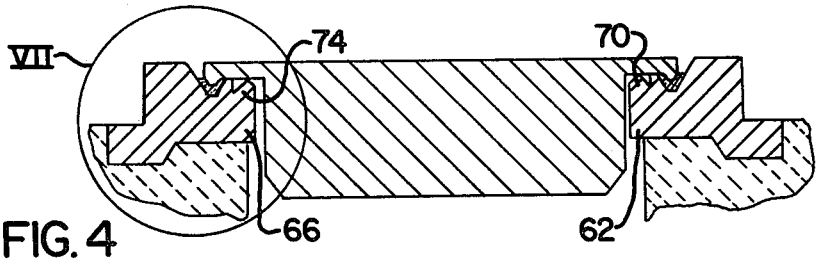
FIG. 4 is a cross sectional view of the charging hole cover and frame taken through line IV—IV in FIG. 1.
Figure 5:
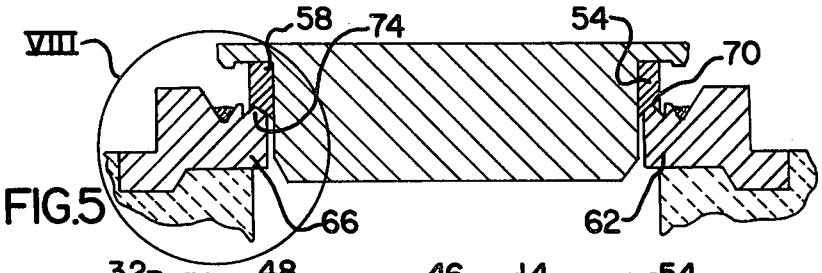
FIG. 5 is another vertical cross sectional view of the charging hole cover and frame of the present invention.
Figure 6:
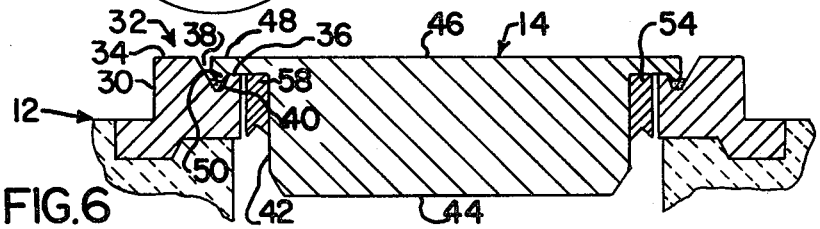
FIG. 6 is a cross section view of the charging hole cover of the present invention taken through line VI—VI in FIG. 1.
Figure 7:
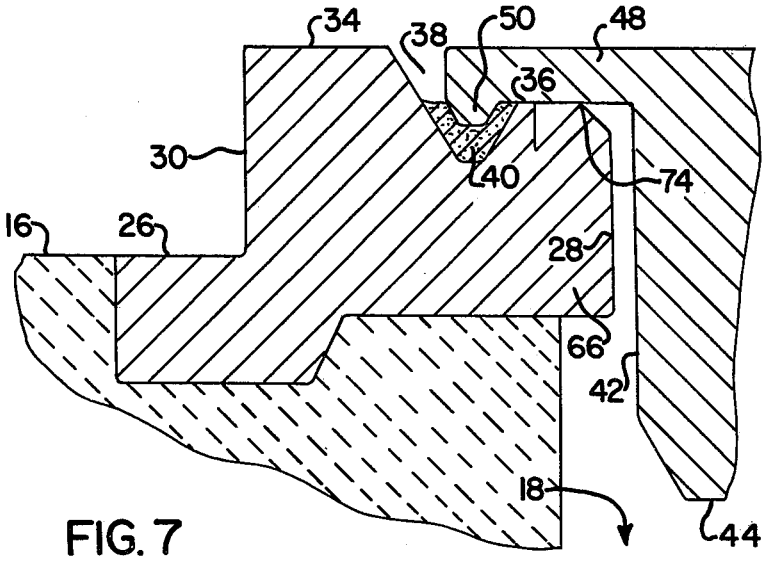
FIG. 7 is a detailed view of the area within Circle VII in FIG. 4.
Figure 8:
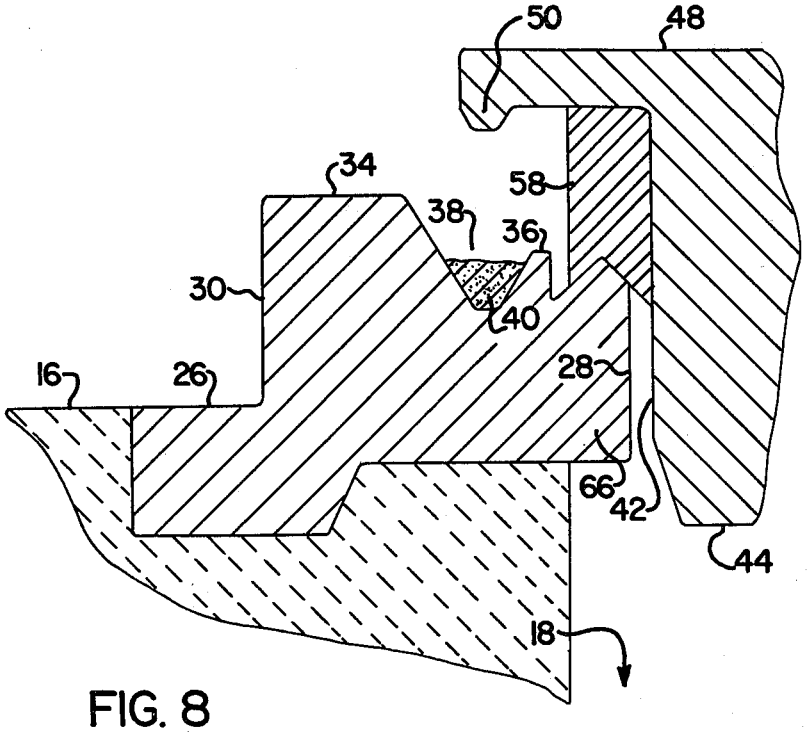
FIG. 8 is a detailed view of the area within Circle VIII in FIG. 5.

Referring to FIGS. 1–3, the sealing structure of the present invention, which is shown generally at numeral 10, consists of a annulus-like frame section, shown generally at numeral 12, and a disc-like cover section, shown generally at numeral 14. The frame section 12 projects upwardly from a coke oven battery top 16 to peripherally enclose a coke oven charging hole 18. The frame section is held in the battery top by supports 20, 22, 24 and 26. The frame has an inner side 28 adjacent the charging hole, an opposite outer side 30, and a top 32. This top 32 is characterized by an outer planar surface 34, an inner planar surface 36, and a medial groove 38. It will be seen from FIGS. 4–8 that this medial groove 38 is partially filled with a heat resistant particulate material 40. This particulate material is preferably ground fireclay, but it may also be possible to use coal fines. Still referring to FIGS. 4–8, it will be seen that the cover 14 is generally disc-shaped and is adapted to be received within the frame 12 and the charging hole 18. It will be seen that the cover 14 has a lateral surface 42 which is inwardly spaced from and concentric with the inner side 28 of the frame. The cover also has a planar lower end surface 44 which faces downwardly into the charging hole and a planar upper end surface 46 which faces upwardly and away from the charging hole. The upper end surface 46 has a peripheral outwardly extending lip which overlaps a portion of the frame 12. The lip 48 has a peripheral, downwardly projecting tongue 50 which engages groove 38 of the frame 12 when the groove is in the position shown in FIGS. 4, 6 and 7. It will also be observed from FIGS. 4, 6 and 7 that when the cover is in this position the lower side of the lip 48 abuts the inner planar surface 36 of the top 32 of the frame 12. Preferably, the outer planar surface 34 of the frame is elevated somewhat over the inner planar surface 36 so that this outer planar surface is coplanar with the upper and surface 46 of the cover. It will, in particular, be seen from FIG. 7 that a primary gravity seal is formed where the lip 48 abuts the inner planar surface 36 of the frame top. In general, this primary seal will prevent the escape of gases which flow upwardly from the charging hole and then between the lateral surface 42 of the cover and the inner side 28 of the frame 12. If, however, any coke oven gases escape between this primary seal, they will initially condense in the particulate material 40 in groove 38 to form a viscous, tarry material that will become mixed with the particulate material. This mixture serves as a sealant, and as a sufficient amount of it accumulates, a particularly effective secondary peripheral seal is formed between the groove 38 and the tongue 50.

Another feature of the present invention is shown in FIGS. 2, 3, 5, 6, 7 and 8. From these figures, it will be seen that four radially projecting lugs 52, 54, 56 and 58 are spaced along the lateral surface 42 of the cover 14 at intervals of 90°. These lugs also project downwardly from lip 48. It will also be seen that four lug retaining ledges 60, 62, 64 and 66 are spaced at intervals of 90° on the inner side 28 of the frame 12. These lug retaining ledges have, respectively, at their upper ends pointed projections 68, 70, 72 and 74. These projections, respectively, engage the grooved lower ends of lugs 52, 54, 56 and 58 when the cover 14 is positioned relative to the frame in the position shown in FIGS. 3, 5 and 8. In this position the lip 48 of the cover 12 is supported over the frame 12 so that the lip no longer abuts the lateral surface 36 and its tongue 50 no longer engages groove 38. In this position there would be fluid communication between the charging hole and ambient air so as to allow the entry of decarbonizing air into the charging hole. Thus, during the decarbonization procedure, the charging hole can remain covered so as to reduce the likelihood that a workman might be injured by accidentally stepping into it. After decarbonization is complete, however, it will be seen from FIGS. 2, 4, 6 and 7 that the charging hole cover 14 may be rotated approximately 25° counter clockwise with respect to the frame 12 so as to bring the lugs out of engagement with the lug retaining ledges and thereby lower the cover so that the lip 48 abuts the inner planar surface 36 and the tongue 50 engages groove 38 so that the above described primary and secondary seals are reformed. A similar clockwise rotation from this lowered position will, of course, again elevate the cover. The charging hole cover of the present invention may be efficiently handled by means of an automatic lid lifter. Since this cover also may remain above the charge hole during decarbonization, it may occasionally be necessary to remove carbon accumulations from the lower end surface 44 of the cover. It is suggested such removal may be effected by placing the cover on a metal grating and then oscillating it about its vertical axis.

It will therefore be understood that there has been described a charging hole cover which has a primary gravity seal and a secondary seal made up of a particulate material which may be mixed with condensed coke oven gases. With the seal of the present invention, the manual application of a sealing compound may be avoided. Although the invention has been described with a certain degree of particularity, it is to be understood that the present disclosure has been made only as an example and that the scope of the invention is defined by what is hereafter claimed.

What is claimed is:

1. A structure for sealing a charging hole on a coke oven battery top comprising:

(a) an annulus-shaped frame section projecting upwardly from the battery top and peripherally surrounding the charging hole and having a generally vertical inner side adjacent the charging hole, and a generally vertical outer side remote from the charging hole and a generally horizontal top end, said top end being positioned between said inner and outer sides and, itself, having integral, concentric inner and outer planar surfaces between which there is interposed a concentric circular groove containing a particulate material;

(b) a disc-shaped cover section superimposed over said charging hole and having a lower end surface disposed toward the charging hole, a peripheral lateral surface inwardly spaced from and concentrically arranged with respect to the inner side of the frame section, and an upper end surface having a lateral lip extension vertically abutting the inner planar surface of the frame section top end, said lip extension having a terminal, peripheral and downwardly projecting tongue engaging said groove of the frame section top end, such that a primary, inward continuous gas seal is formed between said lip extension and said inner planar surface of the frame section top end, and a secondary, outward continuous gas seal is formed between said tongue and said groove;

(c) at least two lugs projecting radially outwardly from the lateral surface of the cover section; and (d) at least two ledges projecting radially inwardly from the inner side of the frame section such that the cover section may be elevated so as to allow fluid communication between the charging hole and ambient air by superimposing each of said lugs on one of said ledges.

2. The structure defined in claim 1 wherein there are four ledges and four lugs and the ledges are spaced at about 90° intervals from one another along the inner surface of the frame section and said ledges each have an upwardly pointed projection and wherein the lugs are spaced at about 90° intervals from one another along the lateral surface of the cover section and said lugs each have lower grooves that are each engageable with one of said upwardly pointed projections on the ledges.

3. The structure as defined in claim 1 wherein the outer planar surface of the frame section top end is elevated above the inner planar surface of said top end such that said outer planar surface is coplanar with the upper end surface of the cover section.

4. The structure as defined in claim 1 wherein the particulate material is ground fire brick.

5. The structure as defined in claim 1 wherein the particulate material is coal fines.

6. The structure as defined in claim 1 wherein the frame section is inwardly circular and outwardly octagonal and wherein four regularly spaced outward supporting structures abut the outer surface of said frame section.

7. The structure as defined in claim 1 wherein the particulate material is a mixture of ground fire brick and coal fines.

* * * * *